US007202605B2

(12) United States Patent
Heppinstall et al.

(10) Patent No.: US 7,202,605 B2
(45) Date of Patent: Apr. 10, 2007

(54) ELECTRON BEAM TUBE APPARATUS HAVING A COMMON OUTPUT COMBINING CAVITY

(75) Inventors: Roy Heppinstall, Witham (GB); David Mark Wilcox, Chelmsford (GB)

(73) Assignee: E2V Technologies Limited, Essex (GB)

( * ) Notice: Subject to any disclaimer, the term of this patent is extended or adjusted under 35 U.S.C. 154(b) by 0 days.

(21) Appl. No.: 10/494,435

(22) PCT Filed: Oct. 31, 2002

(86) PCT No.: PCT/GB02/04929

§ 371 (c)(1),
(2), (4) Date: Feb. 23, 2005

(87) PCT Pub. No.: WO03/038854

PCT Pub. Date: May 8, 2003

(65) Prior Publication Data

US 2005/0116651 A1 Jun. 2, 2005

(30) Foreign Application Priority Data

Nov. 1, 2001 (GB) ..... 0126263.3

(51) Int. Cl.
*H01J 25/04* (2006.01)

(52) U.S. Cl. ..... 315/5.16; 315/5.37

(58) Field of Classification Search ..... 315/5.14, 315/5.16, 5.37
See application file for complete search history.

(56) References Cited

U.S. PATENT DOCUMENTS

| | | | | |
|---|---|---|---|---|
| 2,740,848 | A * | 4/1956 | Starner et al. | 330/56 |
| 3,248,594 | A * | 4/1966 | Boyd | 315/5.14 |
| 3,248,597 | A * | 4/1966 | Boyd et al. | 315/5.16 |
| 3,278,795 | A * | 10/1966 | Mihran | 315/5.14 |
| 3,484,861 | A * | 12/1969 | Dehn | 315/5.16 |
| 5,239,235 | A * | 8/1993 | Mourier | 315/5.14 |
| 5,239,272 | A | 8/1993 | Bohlen et al. | |

FOREIGN PATENT DOCUMENTS

| | | |
|---|---|---|
| EP | 0 788 184 | 8/1997 |
| GB | 2 277 195 A | 10/1994 |
| GB | 2 337 152 A | 11/1999 |

* cited by examiner

*Primary Examiner*—Benny T. Lee
(74) *Attorney, Agent, or Firm*—Venable, LLP; Robert Kinberg; Jeffri A. Kaminski

(57) ABSTRACT

An electron beam tube apparatus comprises a plurality of electron beam tubes having a common output cavity. Power is coupled to the common cavity from the resonant cavities of the beam tubes, and is then fed to an output line. This arrangement permits the outputs of two or more beam tubes to be combined in a compact arrangement with little rf power loss. Previously, the signals from the output lines of respective beam tubes were combined. The output line may be transmission line or waveguide. The means for coupling signals between the cavities may comprise loops or irises, both of which may be selectively adjustable.

6 Claims, 1 Drawing Sheet

ELECTRON BEAM TUBE APPARATUS HAVING A COMMON OUTPUT COMBINING CAVITY

This invention relates to electron beam tube apparatus.

BACKGROUND OF THE INVENTION

Electron beam tubes, such as klystrons and inductive output tubes (IOTs), conventionally comprise three basic elements. Those elements are: an electron gun structure, an rf interaction region and an electron beam collector. Although the invention applies to all types of electron beam tubes it will be described, without loss of generality, with reference to an IOT.

In an IOT, the electron beam is density modulated in the electron gun stricture. The beam passes to the rf interaction region, where rf power is extracted by a resonant cavity system. For TV broadcast applications this consists of a primary cavity attached to the tube and coupled to a secondary cavity (also called an output cavity). Power is coupled from the secondary cavity to an appropriate output feeder line. After passing through the rf element the electron beam impinges on the electron beam collector, the remaining energy of the beam being dissipated on the walls of the collector.

SUMMARY OF THE INVENTION

Operated in this manner, electron beam tubes can be used to produce large amount of power (e.g. kilowatts) at ultra high frequencies. It has been proposed to combine the signals from the output feeder lines of a plurality of beam tube devices in order to produce even greater power. This arrangement may also improve system reliability in that if one tube fails the other tubes can still be operated to produce a reasonable level of output power from the system.

The invention provides an electron beam tube apparatus, comprising a plurality of electron beam tubes having a common output cavity.

The provision of a common output cavity permits the combination of signals from a plurality of tubes in a more compact arrangement than was possible hitherto.

Preferably, means for coupling power from the common output cavity to an output line is provided. This coupling means may comprise a loop arrangement or an iris.

Preferably, the coupling arrangement is selectively adjustable so that the power output may be maximised.

The output line may be rigid transmission line or a coaxial waveguide.

BRIEF DESCRIPTION OF THE DRAWING

The invention will now be described, by way of example, with reference to the accompanying drawings, in which.

DETAILED DESCRIPTION OF THE INVENTION

Figure 1:
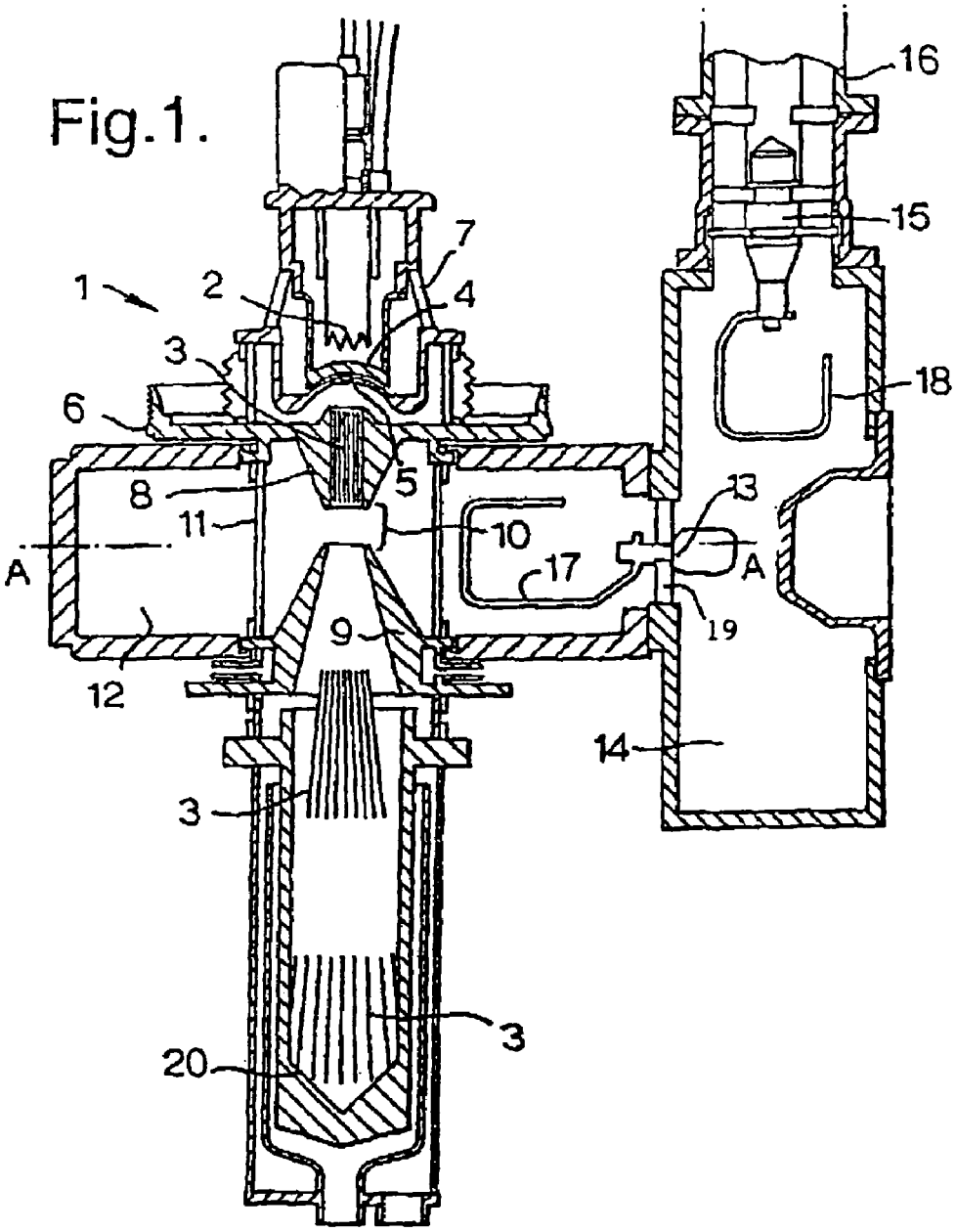
FIG. 1 is a partly sectional plan view of an electron beam tube.

With reference in FIG. 1, an electron beam tube in the form of an Inductive Output Tube (IOT) is shown and indicated generally by the reference numeral 1. The IOT includes an electron gun 2, which is employed to generate an electron beam. The electron beam is represented in this drawing by the group of lines indicated by the reference numeral 3. The magnetic focusing arrangement for the electron beam is not shown in this drawing for clarity.

The electron gun 2 contains a cathode 4, in front of which is placed a grid 5 in close proximity to the cathode. In operation, a high negative voltage of the order of several tens of kilovolts is applied to the cathode 4 and grid structure 5. The tube 1 also has an anode 6, which is at ground potential. A bias voltage, of the order of negative 100 volts to negativerelative cathode potential, is applied to the grid 5. In operation, an rf voltage is applied between the cathode 4 and the grid 5 via a ceramic 7, which forms an interface with the external part of the input cavity (not shown). The application of an rf voltage causes the electron beam 3 to be generated density-modulated.

The density-modulated beam 3 is directed through the rf structure of the device, that is through drift tubes 8 and 9. There is a gap 10 between the drift tubes 8 and 9. Surrounding the drift tubes is a coaxial insulator cylinder 11, such as ceramic. This forms part of the vacuum envelope of the IOT. Surrounding the cylinder 11 is a metal cavity box 12, containing adjustable doors (not shown for clarity). In operation these doors are adjusted so that if the rf cavity box 12 is resonant at the required frequency.

In many applications, such as in a television transmitter, it is necessary to achieve a relatively broad bandwidth from the device. To this end the first (primary) cavity 12 is coupled via suitable coupling means 13 to a secondard cavity 14. This secondary cavity 14 is, in turn, coupled via coupling means 15 to an output feeder line 16. This coupling means 13 and 15 may incorporate loops 17 and 18, each of which can be selectively rotated and whose penetration into their respective cavities can be selectively adjusted. These adjustments permit the user to obtain the best match conditions so that the maximum power is transmitted to the output feeder line 16. In an alternative arrangement, the coupling means may consist of an adjustable iris (not shown) in the common wall 19 of the two cavities 12 and 14.

Finally, after the beam 3 passes the rf structure 8, 9, it enters a collector 20 where its remaining energy is dissipated on the walls of the collector.

For applications in which it is appropriate to combine the output power of two or more IOTs it is customary to lead the output feeder lines of the respective tubes to a combining unit.

Figure 2:
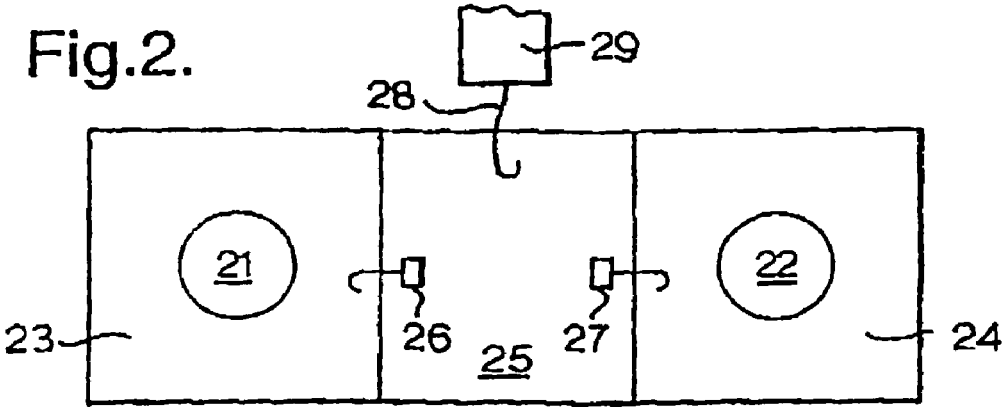
FIG. 2 is a schematic diagram of electron beam tube apparatus constructed according to the invention.

FIG. 2 schematically illustrates an electron beam tube apparatus constructed according to the invention. Two beam tubes 21 and 22 are illustrated, the view of each tube corresponding to a sectional view along the line A—A of FIG. 1. Details of the tubes have been omitted from this drawing for clarity. The beam tubes 21 and 22 are coupled to resonant cavities 23 and 23 respectively, both of which correspond to the resonant cavity 12 of FIG. 1.

In accordance with the invention, a common cavity 25 is provided, coupled to both cavities 23 and 24. Output signals from the tubes 21 and 22 are fed, via adjustable coupling means 26 and 27, to the resonant common cavity 25. The adjustable coupling means 26, 27 may consist of a loop coupling system, an adjustable iris system, a combination of both systems, or any other suitable coupling means. The signals from the two IOTs 21, 22 are therefore combined within the common cavity 25.

The combined signal can be coupled out of the common cavity 25, by suitable coupling means 28, to an output line 29. In one embodiment this would be an adjustable couplings loop system and the transmission line 29 would be a rigid co-axial transmission line. In another embodiment the coupling means 28 might be via an adjustable iris and the transmission line 29 might be a waveguide. Obviously, a number of coupling schemes, which may be different in detail, may be envisaged, but such variations do not detract from the scope of the invention.

The description given above relates to combining the output signals from two tubes in a single common output cavity. The principle may be extended so that the output signals from several IOTs are combined in a single common output cavity. In this case, care has to be taken with the mechanical arrangement of the cavities so that the respective phases of the various rf signals are such that they combine to give a high output power.

The chief advantage of the invention is that it provides a compact combining system. Lower rf power loss may be achievable with apparatus constructed according to the invention than with the prior art arrangement, in which signals from the output lines were combined.

The invention has been described in relation to Inductive Output Tubes, but the invention can equally be applied to any linear beam tube (e.g. a klystron) having a resonant cavity output system.

The invention claimed is:

1. Electron beam tube apparatus, comprising a plurality of inductive output tubes and a common output cavity external to output cavities of the respective inductive output tubes, the common output cavity being respectively coupled to the output cavities of the inductive output tubes to combine the outputs thereof.

2. Apparatus as claimed in claim 1, further comprising means for coupling power from the common output cavity to an output line.

3. Apparatus as claimed in claim 2, in which the means for coupling power comprises a loop arrangement.

4. Apparatus as claimed in claim 2, in which the output line comprises a waveguide.

5. Apparatus as claimed in claim 2, in which the means for coupling power is selectively adjustable.

6. Apparatus as claimed in claim 2, in which the output line comprises a coaxial transmission line.

* * * * *